US005600424A

United States Patent [19]

Malachowski

[11] Patent Number: 5,600,424

[45] Date of Patent: Feb. 4, 1997

[54] SYSTEM FOR CONTROLLING THE MOTION OF FUSED OR UNFUSED COPY SHEETS ENTERING A FUSER NIP

[75] Inventor: Michael A. Malachowski, Webster, N.Y.

[73] Assignee: Xerox Corporation, Stamford, Conn.

[21] Appl. No.: 168,296

[22] Filed: Dec. 17, 1993

[51] Int. Cl.[6] ..... G03G 15/20

[52] U.S. Cl. ..... 399/68; 399/396; 399/309

[58] Field of Search ..... 355/208, 282, 355/285, 286, 289, 290, 295, 308, 309, 310, 326 P, 24; 219/216, 469–471; 318/696

[56] References Cited

U.S. PATENT DOCUMENTS

| | | | |
|---|---|---|---|
| 3,849,628 | 11/1974 | Abowitz et al. | 219/216 |
| 4,427,285 | 1/1984 | Stange | 355/319 X |
| 4,477,176 | 10/1984 | Russel | 355/319 X |
| 4,593,992 | 6/1986 | Yoshinaga et al. | 355/290 X |
| 4,595,279 | 6/1986 | Kuru et al. | 355/282 |
| 4,920,375 | 4/1990 | Akao et al. | 355/326 P |
| 4,941,021 | 7/1990 | Uchida et al. | 355/285 |
| 5,075,732 | 12/1991 | Menjo | 355/282 |
| 5,166,735 | 11/1992 | Malachowski | 355/282 |
| 5,260,751 | 11/1993 | Inomata | 355/282 X |
| 5,289,247 | 2/1994 | Takano et al. | 355/285 |

FOREIGN PATENT DOCUMENTS 61-140438 6/1986 Japan .

*Primary Examiner*—Shuk Yin Lee
*Attorney, Agent, or Firm*—William A. Henry, II

[57] ABSTRACT

A fuser roll nip sheet sensing scheme detects the torque spike of a fuser roll motor when paper is entering the nip region and uses that spike to signal a speed change to the motor to thereby control the motion of the paper. The nip sheet sensing scheme is used for paper position/timing and for single pass duplex fusing.

12 Claims, 4 Drawing Sheets

SYSTEM FOR CONTROLLING THE MOTION OF FUSED OR UNFUSED COPY SHEETS ENTERING A FUSER NIP

BACKGROUND OF THE INVENTION

This invention is directed generally to copy sheet sensing in a copier/printer, and more particularly, to an improved scheme for use in such copiers/printers in sensing when a duplexed, unfused copy sheet enters a fuser nip.

Traditionally, In the process of xerography, a light image of an original to be copied is typically recorded in the form of a latent electrostatic image on a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse an electroscopic toner material onto a support member by heat, it is necessary to elevate the temperature of the toner material to a point at which the constituents of the toner material coalesce and become tacky. This action causes the toner to be absorbed to some extent into the fibers of the support member which in many instances constitutes plain paper. Thereafter, as the toner material is cooled, solidification of the toner material occurs causing the toner material to be firmly bonded to the support member.

In both the xerographic as well as the electrographic recording arts, the use of thermal energy for fixing toner images onto a support member is old and well-known.

One approach to thermal fusing of electroscopic toner images onto a support has been to pass the support with the toner images thereon between a pair of opposed rollers, at least one of which is either externally or internally heated. In this type of arrangement, the toner image contacts the surface of the heated roller member in the nip between rollers to thereby produce heating of the toner image within the nip.

In apparatus utilizing a fuser roll pair as described above, it is important that the heated roll surface be maintained within a suitable range to properly fuse the toner image to its paper support sheet. The foregoing is accomplished in a conventional manner by the employment of a temperature sensitive resistance device commonly referred to as a thermistor which is placed in physical contact with the heated roll.

In a conventional roll fuser, the fuser roll or heated member is almost always provided with a release agent applied to the surface thereof in order to prevent offsetting of toner material to the fuser roll. The release agent is, at least at the time that the application to the fuser roll has been accomplished, in the form of a liquid and has the effect of minimizing the thermal energy generated by frictional forces due to rubbing between the fuser roll surface and the thermistor. Alternatively, as shown in U.S. Pat. No. 3,849,628, the fuser roll surface could comprises an elastomeric or other highly susceptible heat generating material that does not have a release agent applied to the surface thereof.

A problem arises when it becomes necessary to sense the instant a copy sheet enters the fuser nip because it becomes extremely difficult, if not impossible, to position the embodiment of a sensing device exactly at the roll nip contact point. Sensing of the fuser roll nip contact point is important in copiers/printers when single pass duplex is practiced, i.e., when unfused images are placed onto both sides of a copy sheet and then the copy sheet is fused. It has been found that conventional fuser roll speeds for copy sheets with only one image thereon are inadequate for unfused, duplex imaged copy sheets because the images are not fused properly due to the speed of the fuser roll nip being too fast.

SUMMARY OF THE INVENTION

Accordingly, in an aspect of this invention, a fuser nip sheet sensing scheme is disclosed that detects the torque spike of the fuser motor when a copy sheet is entering the nip region and sends a signals to the fuser motor to change the speed of the motor and thereby control the motion of the copy sheet.

BRIEF DESCRIPTION OF THE DRAWINGS

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of a conventional electrophotographic printing machine which is incorporated herein by reference and in which the features of the present invention may be incorporated, reference is made to U.S. Pat. No. 4,477,176 which depicts schematically the various components thereof. Although the nip sensing scheme disclosed herein is particularly well adapted for use in the electrophotographic printing machines, it should become evident from the following discussion that it is equally well suited for use in a wide variety of devices and is not necessarily limited in this application to the particular embodiment shown herein.

Figure 1:
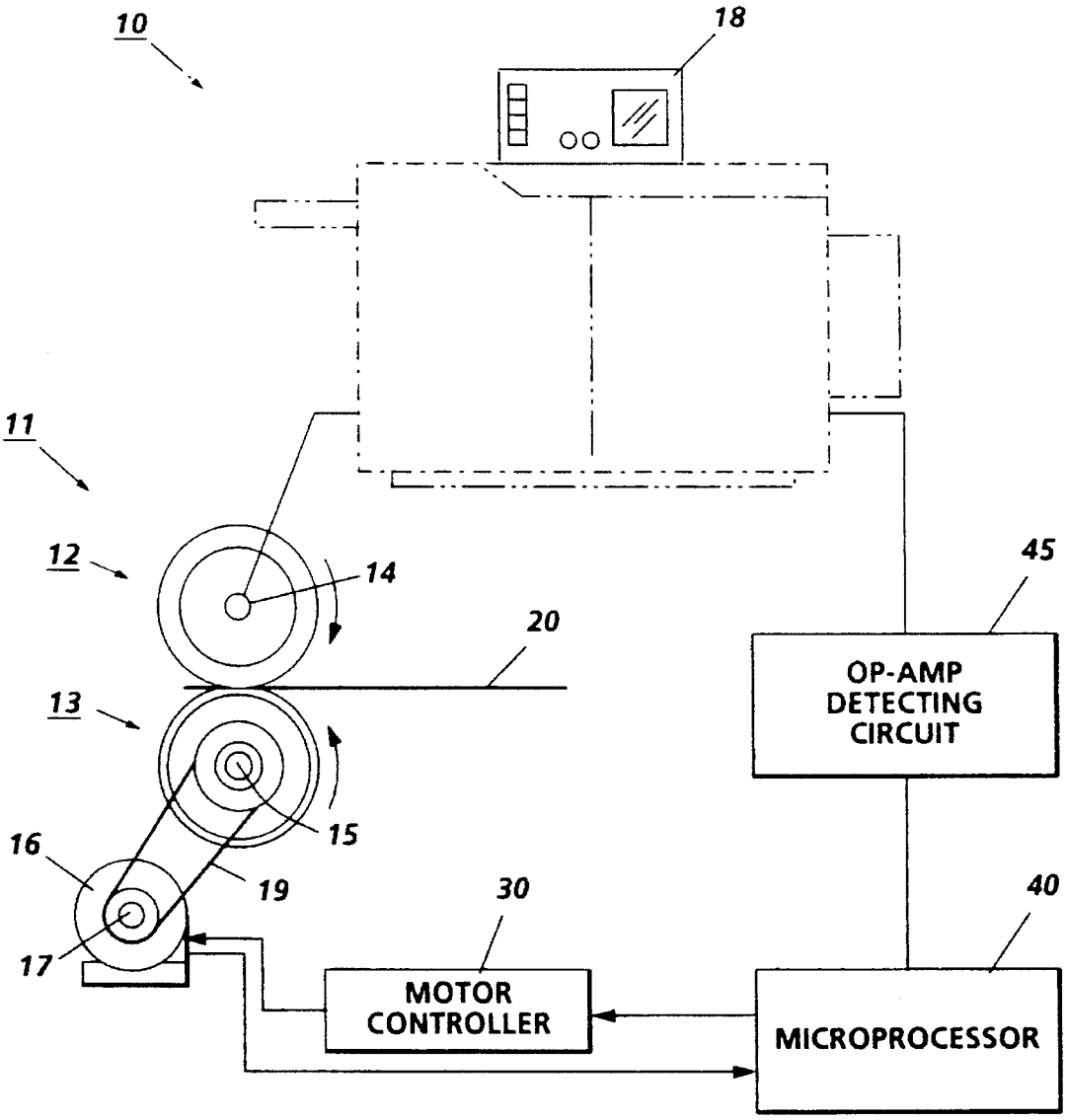
FIG. 1 is a schematic elevational view of a fuser for an electrophotographic printing machine incorporating the nip sensing scheme of the present invention.

Since the practice of electrophotographic printing is well known in the art, reference is made to FIG. 1 of the present invention where conventional copier/printer 10 including a fuser roll nip copy sheet sensing scheme is shown. In FIG. 1, a fuser apparatus 11 is shown that includes fuser roll 12 and a backup roll 13. The fuser roll is mounted for rotation on shaft 14 in the direction of the arrow and backup roll 13 is rotated by movement of shaft 15. Shaft 15 is connected to motor 16 by belt 19 which is rotatably mounted on shaft 17 of motor 16. The speed of motor 16 is set for proper fusing of copy sheets 20 that have unfused images on one side of the copy sheet. But, present day machines are capable of placing unfused images on both sides of a copy sheet before the copy sheet is advanced to the fuser for fusing of the images to the copy sheet. This is sometimes referred to as simultaneous duplex and the fuser knows when this option is selected as a result of the selection being made on the console or control panel 18 of machine 10 by an operator. While the fuser nip speed is ideal for single side imaged sheets, it is not adequate for duplexed, unfused images since the duplexed images will pass through the fuser too quickly for the unfused images on both sides of the copy sheet to tack to the copy sheet as desired. One way of accomplishing solid fusing of duplexed images is to employ signature analysis algorithm schemes when a motor torque spike is encountered due to the shock of copy sheet entry into the fuser nip between rolls 12 and 13. As shown, a signal is sent to a conventional microprocessor 40 that is adapted to receive the signal from the instant a copy sheet 20 enters the fuser nip. Microprocessor 40 is connected to the machine 10 through an operational amplifier 45. The signal is interrogated for validity and a command is sent to motor controller 30 to reduce roll speed of backup roll 13, thus giving the double imaged copy sheet more time to pass through the fuser and thereby allowing the toner on the copy sheet more time to coalesce properly.

While this nip sensing scheme is disclosed in a preferred embodiment for sensing when a sheet enters a fuser nip, it should be understood that it could be used in any situation where nip sensing is desired, for example, for paper position/timing throughout the paper path of a machine.

Figure 2:
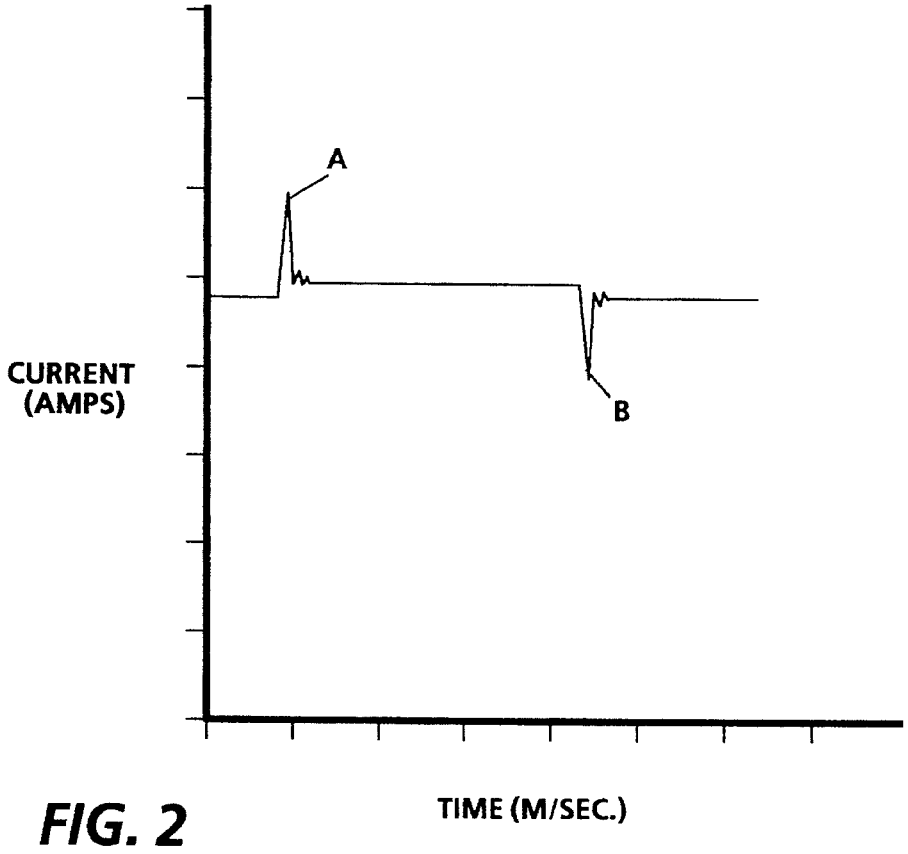
FIGS. 2 through 7 are torque plots showing the fuser roll nip current spike repeats for varying weights of paper and fuser nip speeds.
Figure 3:
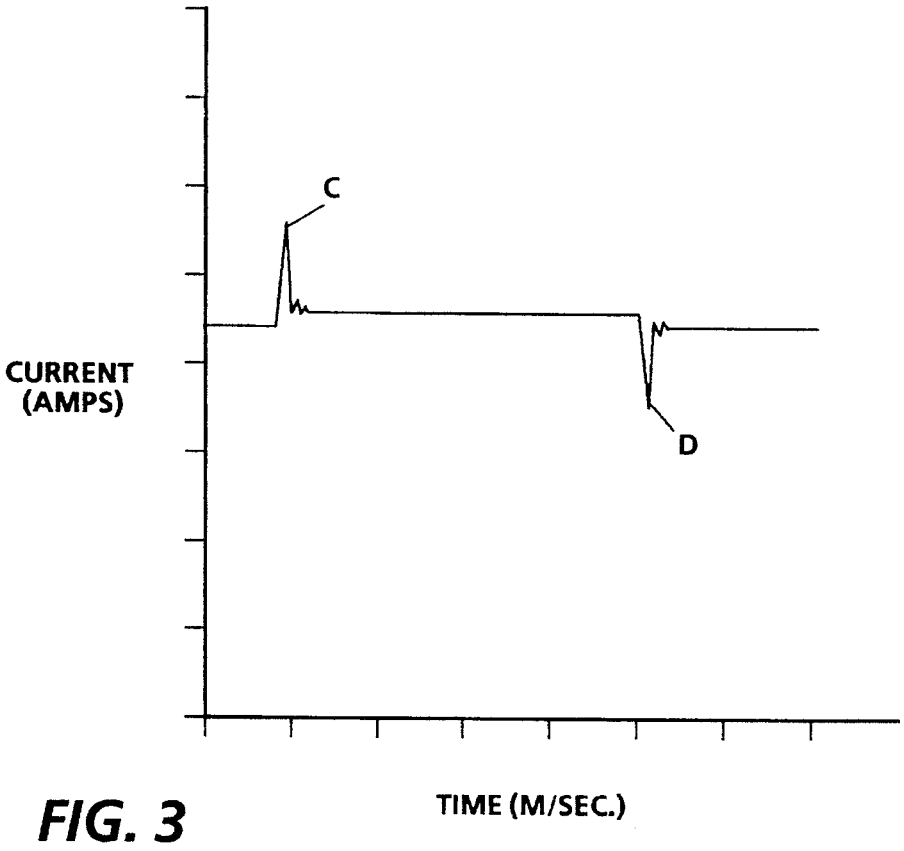
Figure 4:
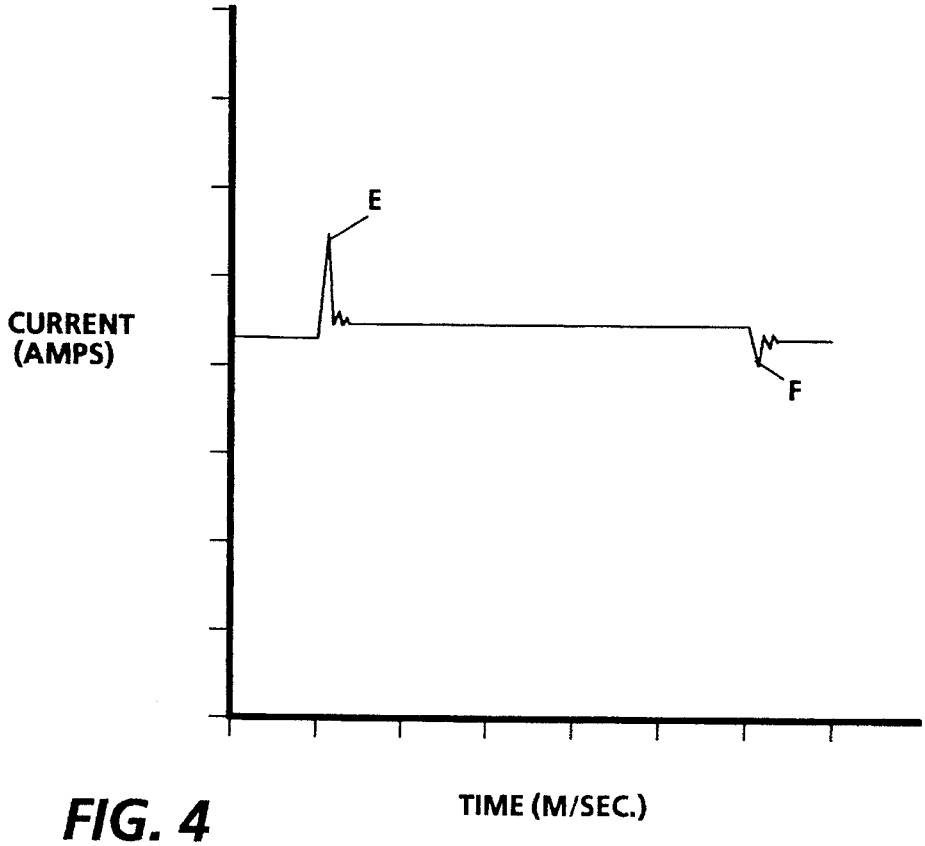
Figure 5:
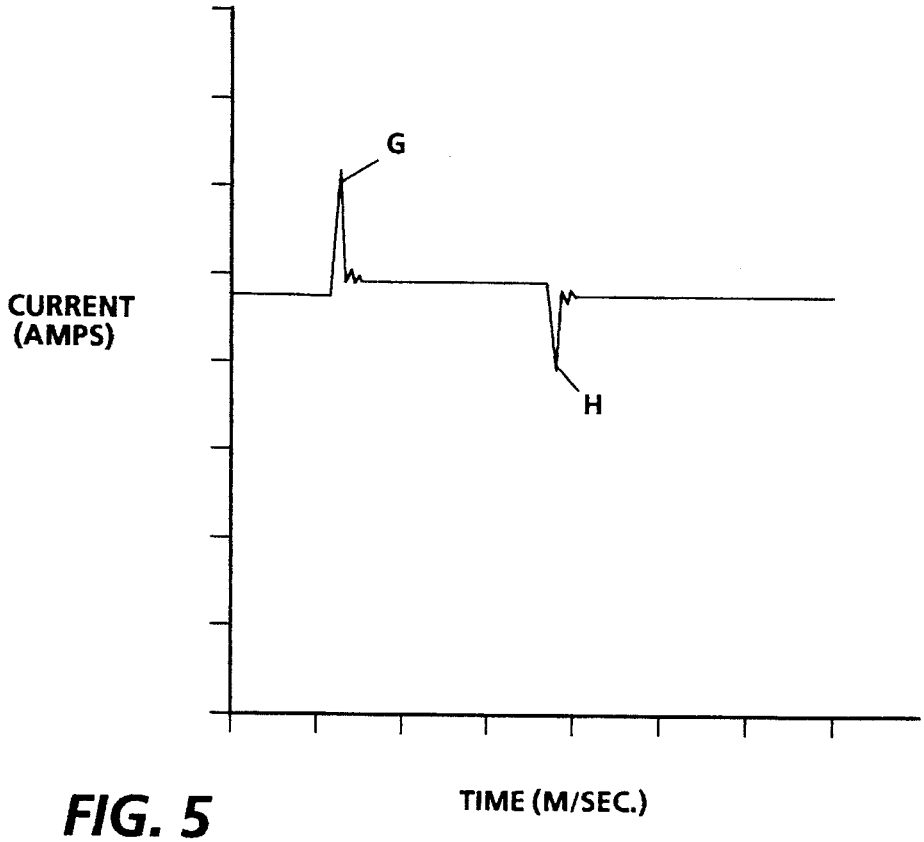
Figure 6:
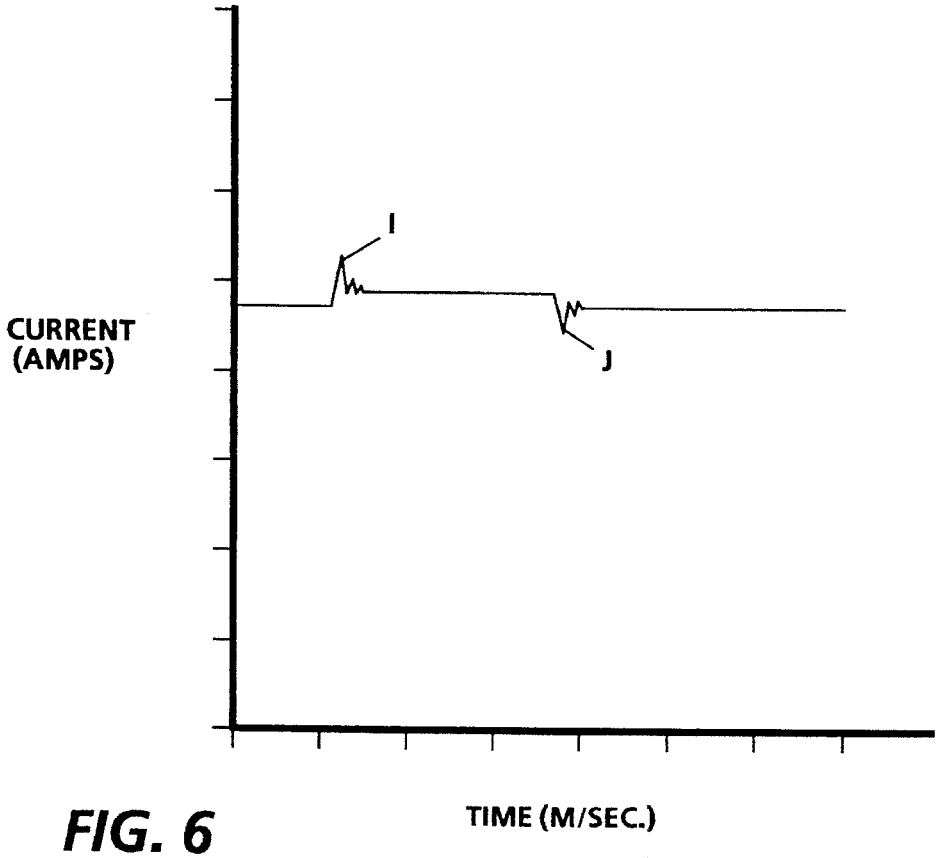
Figure 7:
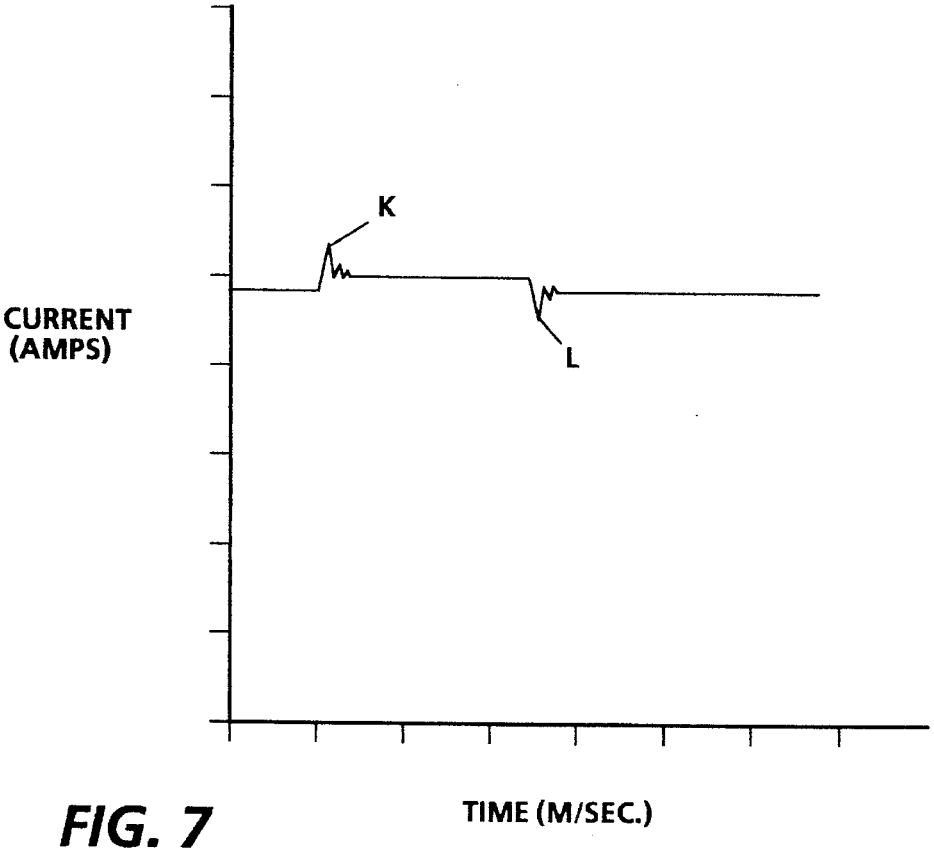

With respect to FIGS. 2–7, various torque plots are shown that include fuser/paper entry and exit current spikes for different weights of paper and fuser nip speeds. These tests were performed using a D. C. motor connected through a timing belt drive to a fuser assembly. A current probe was placed between a D. C. power supply and the motor and current traces were generated. In FIG. 2, a trace of current vs. time clearly indicates a torque spike upon entry of paper into the fuser nip at A and exit of paper from the fuser nip at B. This trace is for 20 lb paper entering a fuser nip at 5.0 inches/sec and 0.5 amp/div. FIG. 3 shows a spike C upon entry of 13 lb paper into a fuser nip and a spike at D when the paper exits the nip. The paper was transported through the nip at 5.0 inches/sec and 0.5 amp/div. As can be seen from FIG. 4, when the only parameter changed from the set up of FIG. 3 is from 5.0 inches/sec to 4.0 inches/sec, there is not much difference in spikes for paper entry into the fuser at E and paper exiting the fuser at F. FIG. 5 shows current spikes at G for paper entering the fuser nip and at H for paper exiting the fuser nip for 110 lb paper moving through the nip at 8.0 inches/sec and 0.5 amp/div. At 8 inches/sec and 0.05 amp/div. in FIG. 6, the spikes for 20 lb paper are barely discernible, but does trigger a spike at I for paper entry into the fuser and at J for paper exiting the fuser. Similarly, At 8 inches/sec and 0.05 amp/div. in FIG. 7, the spikes for 13 lb paper are shown at K for paper entering the fuser and at L for paper exiting the fuser.

In conclusion, a two speed fuser has been disclosed which incorporates a nip sheet sensing scheme that senses the exact point at which a sheet contacts the fuser nip through a current spike that is given off at sheet nip contact. With receipt of this signal by a microprocessor, a motor control is commanded by the microprocessor to slow the speed of the fuser motor when simultaneous duplex is required in order to ensure that both unfused images on a copy sheet are fused properly. Once simultaneous duplexing is accomplished, the fuser speed is returned to normal by the microprocessor. Also, this nip sensing spike output can be used to sense the position of paper when it reaches a motor driven roller without the cost and placement of individual mechanical, optical, or electrical sensors, as well as, detect copy sheet basis weight.

It is, therefore, evident that there has been provided in accordance with the present invention a nip sheet sensing scheme has been disclosed which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A two speed fuser apparatus, comprising:

a first roller;

a second roller cooperating with said first roller to form a nip through which a substrate supporting toner material is moved;

a heater for heating at least one of said rollers to elevate a surface temperature thereof to a level sufficient to render the toner material tacky;.

a motor connected to one of said rollers for driving said one of said rollers at a predetermined one of two speeds upon demand;

a motor control for controlling a driving speed of said motor and thereby the speed of said at least one roller; and a microprocessor connected to said motor to monitor spikes in current created by entry and exit of a copy sheet into and from said nip, said microprocessor signaling said motor control to reduce the speed of said motor from a first speed to a second speed when a copy sheet with an unfused, duplexed image thereon enters said nip and return said motor to said first speed when the copy sheet exits said nip.

2. The two speed fuser apparatus of claim 1, wherein said first roller is a fuser roll and said second roller is a backup roller.

3. The two speed fuser apparatus of claim 2, including a belt connecting said motor to said backup roll.

4. The two speed fuser apparatus of claim 1, wherein said motor operates at said first speed for single sided copying and at said second speed for simultaneous duplexing.

5. A reproduction apparatus that place page image information onto one side of copy sheets or both sides of copy sheets before forwarding the copy sheets to a fusing apparatus that fuses the images to the copy sheets, the fuser apparatus comprising:

a first roller;

a second roller cooperating with said first roller to form a nip through which a substrate supporting toner material is moved;

a heater for heating at least one of said rollers to elevate a surface temperature thereof to a level sufficient to render the toner material tacky;

a motor connected to one of said rollers for driving said one of said rollers at a predetermined one of two speeds upon demand;

a motor control for controlling a driving speed of said motor and thereby the speed of said at least one roller; and a microprocessor connected to said motor to monitor spikes in current created by entry and exit of a copy sheet into and from said nip, said microprocessor signaling said motor control to reduce the speed of said motor from a first speed to a second speed when a copy sheet with an unfused, duplexed image thereon enters said nip and return said motor to said first speed when the copy sheet exits said nip.

6. The reproduction apparatus of claim 5, wherein said first roller is a fuser roll and said second roller is a backup roller.

7. The reproduction apparatus of claim 6, including a belt connecting said motor to said backup roll.

8. The reproduction apparatus of claim 5, wherein said motor operates at said first speed for single sided copying and at said second speed for simultaneous duplexing.

9. A two speed fuser for use in a copier/printer apparatus that makes single sided and duplexed copies, comprising:

a first roller;

a second roller cooperating with said first roller to form a nip through which a substrate supporting toner material is moved; and a motor connected to one of said rollers for driving said one of said rollers at either one of predetermined two speeds upon demand, and wherein said motor operates at said first predetermined speed for single sided copying and at said second predetermined speed for simultaneous duplexing.

10. The fuser apparatus of claim 9, wherein said first roller is a fuser roll and said second roller is a backup roller.

11. The fuser apparatus of claim 10, including a belt connecting said motor to said backup roll.

12. A sheet sensing scheme for sensing positional location of a single sheet upon initial contact of the sheet with a drive nip, comprising:

a fixedly positioned, rotatable first roller;

a fixedly positioned, rotatable second roller in contacting relationship with and cooperating with said first roller to form a nip through which a single sheet is moved;

a motor connected to one of said rollers for driving said one of said rollers at a predetermined speed at a predetermined current; and circuitry means for monitoring the current to said motor during the driving of said at least one roller by said motor control at said predetermined speed and detecting only a spike in the current that indicates entry of a single sheet into said nip through which a sheet is driven and thereby said positional location of the sheet.

* * * * *